US010522923B2

(12) United States Patent
Beauchamp

(10) Patent No.: US 10,522,923 B2
(45) Date of Patent: Dec. 31, 2019

(54) ELECTRICAL CONNECTOR WITH A QUICK RELEASE FASTENER

(71) Applicant: Bollhoff Unifast srl, Settimo Torinese (IT)

(72) Inventor: Simon Robert Beauchamp, Alresford Hampshire (GB)

(73) Assignee: Bollhoff Unifast SRL, Settimo, Torinese (IT)

( * ) Notice: Subject to any disclaimer, the term of this patent is extended or adjusted under 35 U.S.C. 154(b) by 0 days.

(21) Appl. No.: 15/746,412

(22) PCT Filed: Jul. 19, 2016

(86) PCT No.: PCT/EP2016/067181
§ 371 (c)(1),
(2) Date: Jan. 21, 2018

(87) PCT Pub. No.: WO2017/013116
PCT Pub. Date: Jan. 26, 2017

(65) Prior Publication Data

US 2018/0205158 A1 Jul. 19, 2018

(30) Foreign Application Priority Data

Jul. 22, 2015 (GB) ..... 1512921.6

(51) Int. Cl.

| | |
|---|---|
| ***H01R 4/30*** | (2006.01) |
| ***H01R 4/52*** | (2006.01) |
| ***H01R 4/48*** | (2006.01) |
| ***H01R 11/12*** | (2006.01) |

(52) U.S. Cl.
CPC ..... *H01R 4/302* (2013.01); *H01R 4/52* (2013.01); *H01R 11/12* (2013.01); *H01R 4/4872* (2013.01); *H01R 2201/26* (2013.01)

(58) Field of Classification Search
CPC ..... F16B 21/04; H01R 4/4872; H01R 4/48; H01R 4/52; H01R 4/50; H01R 4/5008; H01R 11/12; H01R 13/623; H01R 9/26; Y10T 403/5766; Y10T 403/5793
See application file for complete search history.

(56) References Cited

U.S. PATENT DOCUMENTS 1,694,239 A 12/1928 Thonsen
9,774,108 B2 * 9/2017 Takashima ..... H01R 9/22

OTHER PUBLICATIONS

PCT/EP2016/067181, International Search Report dated Oct. 27, 2016, 3 pages.
PCT/EP2016/067181, Written Opinion dated Oct. 27, 2016, 5 pages.

* cited by examiner

*Primary Examiner* — Vanessa Girardi
(74) *Attorney, Agent, or Firm* — Arrigo, Lee, Guttman & Mouta-Bellum LLP; Harry J. Guttman

(57) ABSTRACT

An electrical connector (2) comprising a quarter turn fastener (4), the quarter turn fastener (4) comprising a stud (6) having at least one helical cam slot (8) and a receptacle (10) comprising at least one cam follower (24) and a biasing means (12), the connector further comprising means for connection (14) to an electrical assembly, wherein the electrical connector has a first electrical contact surface (16) and a second electrical contact surface (17) and releasably connects the first and second surfaces in operative engagement, and wherein the electrical connector maintains a constant clamp force across the surfaces.

28 Claims, 8 Drawing Sheets

ELECTRICAL CONNECTOR WITH A QUICK RELEASE FASTENER

This application is a National Stage Entry of International Application No. PCT/EP2016/067181 filed Jul. 19, 2016, entitled "ELECTRICAL CONNECTOR AND METHOD FOR CONNECTING" which is herein incorporated by reference in its entirety, and which claims priority to GB Application No. 1512921.6, filed Jul. 22, 2015, entitled "ELECTRICAL CONNECTOR" which is herein incorporated by reference in its entirety.

FIELD

The present invention relates to an electrical connector.

BACKGROUND

A significant advantage of a bolted joint over other fastener types, such as welded and riveted joints, is that such bolted joints are capable of being disconnected. This can, however, cause problems if loosening and/or subsequent disconnection unintentionally occurs as a result of operational conditions. Such unintentional loosening, often called vibrational loosening, may be caused by the side movement of the nut or bolt head relative to the joint, resulting in relative motion occurring in the threads of the fastener. Such joints are acceptable for use in equipment where the joint is not undergoing high vibrations. However, problems may occur when the joint is subject to high vibrations and/or when high dynamic loads are applied. During vibrations, localised slip at the bolt/ nut contact surfaces can loosen threaded fasteners. Friction-based, spring-based and interference-fit fasteners do not handle these conditions well because of their natural tendency to follow the threads and make the bolt move away from the joint. A nut has a preferred direction of rotation when subjected to vibrations and thread friction has been overcome. Only a small amount of vibration-induced fastener movement can significantly reduce the clamp load and once some clamp load is lost and the bolt moves even more, further clearance is created in the shaft and the weakening bolts can shear due to wear and tear.

Thus, pre-loaded bolts or nuts may rotate and become loose due to relative motion occurring between the male and female threads of the fastener. Three common causes of relative motion are: (1) bending of parts which results in the forces being induced at the friction surface. If slip occurs, the head and the threads will slip which may lead to loosening; (2) differential thermal effects caused as a result of either differences in temperature or differences in clamped materials; and/or (3) applied forces on the joint which can lead to shifting of the joint surfaces leading to bolt and/or nut loosening. In general, the key to preventing self loosening of fasteners is to ensure that, for example, there is sufficient clamp force present on the joint interface to prevent relative motion between the bolt head or nut and the joint; and that the joint is designed to allow for the effects of embedding and stress relaxation.

Rotatable captive nuts have been used on equipment where access is required for servicing and/or electrical disconnection is required for safety. The provision of a captive nut reduces the possibility that the nut may be lost when disconnected. In addition, the use of a captive nut reduces the number of components required during assembly of a system.

Rotatable captive nuts often comprise threaded fasteners. However, such threaded fasteners do not allow for rapid assembly and/or disassembly of a system such as a unit or other installation. In addition, during assembly of the system, the threaded fastener must be tightened to create a preload across the assembled joint such that energy is introduced in the form of tension, torsion and/or bending energy. This energy is held within the threaded fastener via friction produced by the mating of the male and female threads of the fastener and by the contact thrust faces of the nut. In the event that the frictional force is overcome, the energy that is stored in the fastener and the preload that has been generated will be lost. This may occur gradually over a period of time and may be caused by vibration. Depending on the nature of the vibrations and other conditions, there will be a finite resultant loosening torque that the fastener system has to resist. Therefore, if bolts are tightened to a particular preload in such a way that the remaining tension of the bolt under applied load is adequate to generate a friction torque larger than the loosening torque vibration, vibrational loosening will not occur. Without the preload, the fastener assembly will become loose and will eventually come apart as the male and female components of the threaded fastener disengage.

To gain enough thread friction to withstand vibrational loosening requires a higher torque and subsequent clamp load across the joint than is necessary to maintain the electrical contact. This higher torque requires a stronger structure around the stud head and mounting to withstand these torsional forces. Therefore, the supporting structure is over engineered. Assembly and reassembly after disassembly requires the use of speciality tools to ensure that the correct torque is applied. For example, such assembly and reassembly may require the use of a torque wrench. Torque is an unreliable method of tightening since it is influenced by many factors including lubrication, surface finish, thread surface damage and mating surfaces.

Also, when using a threaded fastener, a significant proportion of the clamp load that is provided across the fastened joint is required to maintain the friction across the threaded connection and to prevent the fastener from becoming loose.

In addition, thermal shock and the application of a load to a joint may cause the fastener to come undone. This is a particular problem when the threaded fastener is used with an electrical connection. In this case, a loose electrical connection may result in the passage of a high current through a system, resulting in the generation of heat which may result in fire or other heat damage.

It is an object of the invention to seek to mitigate problems such as the aforementioned.

DETAILED DESCRIPTION

According to a first aspect, there is provided an electrical connector comprising a quarter turn fastener, the quarter turn fastener comprising a stud having at least one helical cam slot and a receptacle comprising at least one cam follower and a biasing means, the connector further comprising means for connection to an electrical assembly, wherein the electrical connector has a first electrical contact surface and a second electrical contact surface and releasably connects the first and second surfaces in operative engagement, and wherein the electrical connector maintains a constant clamp force across the surfaces.

The person skilled in the art would understand that the quarter turn fastener of the invention is a term of the art which describes a particular type of fastener and is not necessary limited to a fastener that rotates through 90 degrees. Indeed, rotation of the fastener through approximately 90 to 180 degrees, and typically through approximately 140 degrees may be involved.

Advantageously, the electrical connector of the present invention has the benefit of maintaining a constant clamp force across the connector whilst resisting the effects of vibration and the risk of unwanted disconnection of the connector. Advantageously, the connector provides for secure connection and/or disconnection of the fastener, whilst being simple to operate.

Advantageously, the electrical connector provides a quick detachable fastening and/or securing means enabling the quick and easy connection and/or disconnection of one part to or from another.

Advantageously, the electrical connector provides a surface area for electrical contact to permit passage of high current through a system without overheating. Thus, the electrical connector advantageously provides a secure connection when the parts of the connector are engaged with one another, allows for quick disconnection and reconnection of the fastener, and allows for the passage of high current through the system.

Preferably, the quarter turn fastener comprises a body having a head at one end thereof. Preferably, the body is substantially cylindrical in shape and comprises a central longitudinal axis. Preferably, the body extends between a first end and a second end wherein the second end of the body is attached to the head. Typically, the longitudinal axis of the body is substantially perpendicular to the longitudinal axis of the head. In one embodiment, the head is substantially circular in shape. In another embodiment, the head has a substantially square shape. Preferably, the body extends from the underside of the head and is smaller in diameter than the diameter of the head. Typically, the body comprises at least one helical cam slot at one end thereof. Preferably, the at least one helical cam slot is provided at the end of the body distal to the end attached to the head. Preferably, the body comprises a pair of diametrically opposed helical cam slots. Typically, each cam slot is cut from the leading end of the body and extends along the body towards the head. Typically, the at least one cam slot has a spiral configuration. In one embodiment, the open end of the at least one cam slot may be widened to facilitate coupling and/or uncoupling of the stud with the at least one cam follower of a complementary receptacle. Preferably, the at least one cam slot has a bayonet configuration and extends from the leading end of the body towards the head, terminating at a locking detent wherein the corresponding cam follower preferably sits when the stud is connected to the receptacle.

Preferably, the diameter of the stud at the end comprising at least one cam slot is between 5 and 10 mm. In other embodiments, smaller or larger diameters of the stud may be used. Preferably, the diameter of the receptacle is sized to correspond to the diameter of the stud. Typically, the diameter of the receptacle may be between 5 and 15 mm. Preferably, the stud comprises steel or stainless steel.

Advantageously, the use of the electrical connector of the present invention avoids the requirement of an additional threaded locking mechanism, or the use of anti-vibration washers.

In one embodiment, the receptacle is substantially cylindrical in shape. In another embodiment, at least part of the receptacle has the shape of a hexagonal prism. Preferably, the receptacle comprises an inner recess shaped to accommodate the body of the stud. Preferably, the inner recess is substantially hexagonal in shape. Preferably, the biasing means are accommodated within the inner recess. Preferably, the biasing means comprises a spring. Preferably, the receptacle further comprises an interface plate, wherein the interface plate preferably comprises at least one cam follower. Typically, the spring and the interface plate are captivated within the receptacle. Typically, the interface plate is not rotatable within the receptacle but may be free to move axially within the receptacle against the spring pressure. Preferably, the shape of the interface plate corresponds to the shape of the recess of the receptacle.

Preferably, the interface plate comprises two cam followers which correspond to an engage with a corresponding cam slot provided on the stud. Preferably, the interface plate comprises a pair of diametrically opposed inwardly extending cam followers, preferably in the form of a pair of tabs directed across the plate. Preferably, the at least one cam follower is configured to engage with the at least one cam slot provided on the stud. Typically, as the body of the stud is introduced an open end of the receptacle it comes into contact with the cam followers provided on the interface plate, wherein the cam followers may be aligned with the entrance to the cam slots by a small initial rotation of the stud. Typically, the at least one cam follower may be held in place after connection with the stud via the locking detent provided within the at least one cam slot. Advantageously, the biasing means allows for relative axial movement of the cam follower and stud within the receptacle, facilitating connection and disconnection of the fastener.

Preferably, the at least one cam slot is provided on the stud to allow for quarter turn rotation of the body of the stud with respect to the receptacle to open and/or close the fastener, respectively. Preferably, the body of the stud rotates through between 90 and 180 degrees, preferably through approximately 140 degrees, with respect to the receptacle, to open and/or close the fastener.

Preferably, the receptacle comprises brass, aluminium, plastics, steel or stainless steel. Preferably, the stud, spring and/or interface plate comprise steel or stainless steel.

Preferably, the connector further comprises a post such as a battery post comprising an aperture. Preferably, the aperture is substantially circular in shape. Typically, the aperture is dimensioned to accommodate the body of the stud such that the body of the stud may pass through the aperture. Typically, the receptacle is mounted on the battery post, typically through use of an undercut or deformable flange to encompass all or part of the post thickness. Preferably, the stud is captivated to the post. Preferably, the head of the stud is fixed to the post and doesn't rotate with the post.

Preferably, the means for connection to an electrical assembly comprises a spade. Typically, the spade comprises an aperture. It is preferred that the aperture is substantially cylindrical and preferably has substantially the same diameter as the aperture provided within the post. Typically, the means for connection to an electrical assembly may further comprise a plurality of cables which lead to a battery. Preferably, the receptacle is captivated to the spade but able to rotate to enable assembly. Preferably, the flange face of the receptacle is formed such that it corresponds with the spade to which it is captivated.

Typically, the body of the stud passes both through the aperture of the post and the aperture of the spade and is accommodated within the receptacle.

In a preferred embodiment, the electrical connector may be used for connection to a battery in a car or other vehicle. Advantageously, the electrical connector of the present invention allows for quick disconnection of the fastener which is of great benefit when vehicles are loaded onto a ship, train or other transport means, wherein the battery of the vehicle is required to be disconnected before transport begins. After the ship has docked and the vehicles are ready to be unloaded, the electrical connector of the invention allows for quick reconnection of the fastener to reconnect the battery of the vehicle.

A method for connecting an electrical connection comprising an electrical connector in accordance with the first aspect.

Preferably, the method comprises connecting a stud having at least one helical cam slot and a receptacle comprising at least one cam follower and a biasing means, the method further comprises providing a first electrical contact surface and a second electrical contact surface and releasably connecting the first and second surfaces in operative engagement, and wherein the electrical connector maintains a constant clamp force across the surfaces.

Typically, the method comprises the step of passing the body of the stud through an aperture provided within a spade before connection of the stud and receptacle. Preferably, the method comprises the step of passing the body of the stud through an aperture provided within a post, such as a battery post.

A method of making an electrical connector in accordance with the first aspect.

A kit comprising an electrical connector in accordance with the first aspect.

The invention will be further described by way of example, with reference to the following drawings and figures, in which.

Figure 1A:
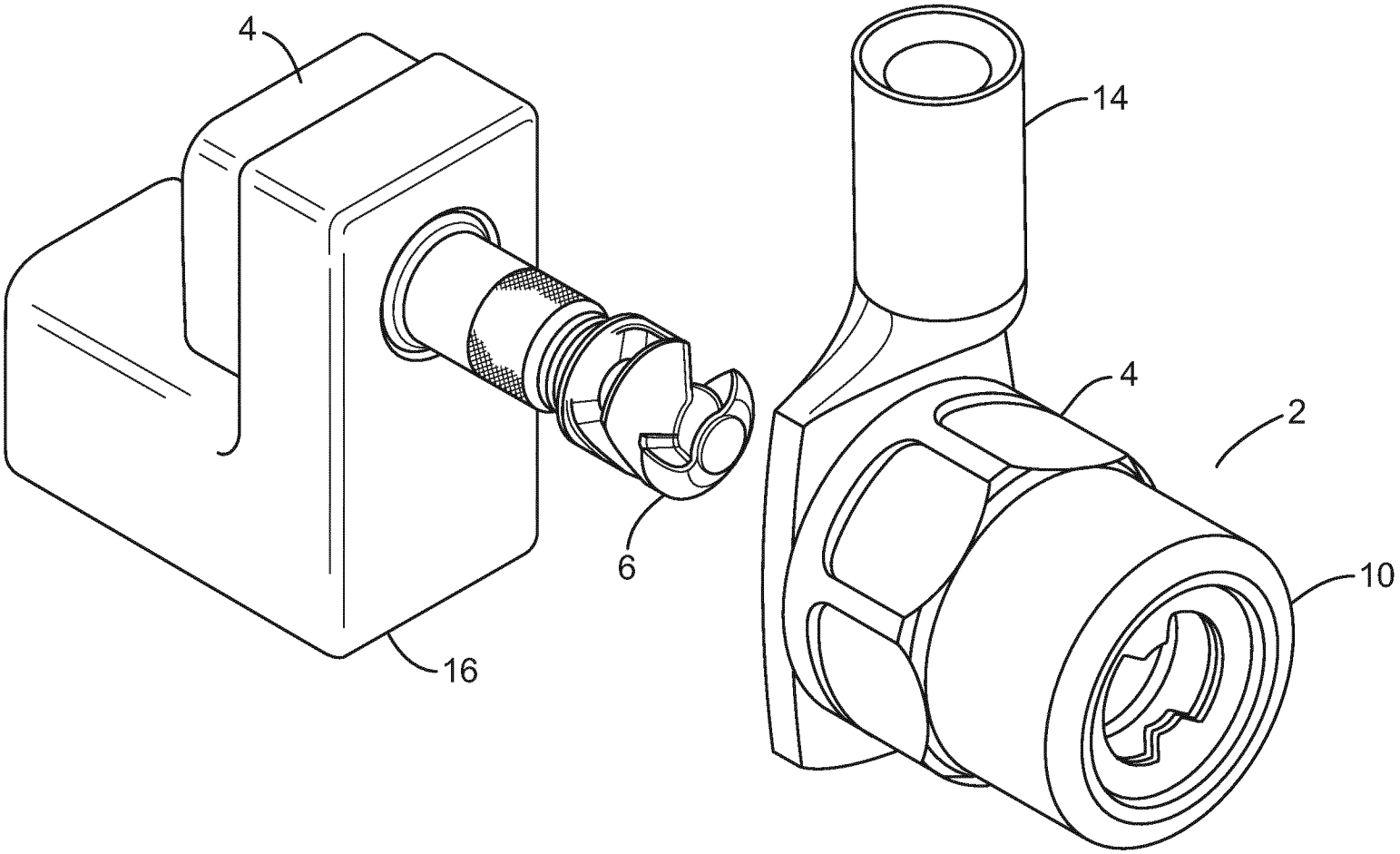
FIG. 1A is a schematic perspective view of the electrical connector according to one embodiment of the invention, wherein the connector is in a disassembled configuration.
Figure 1B:
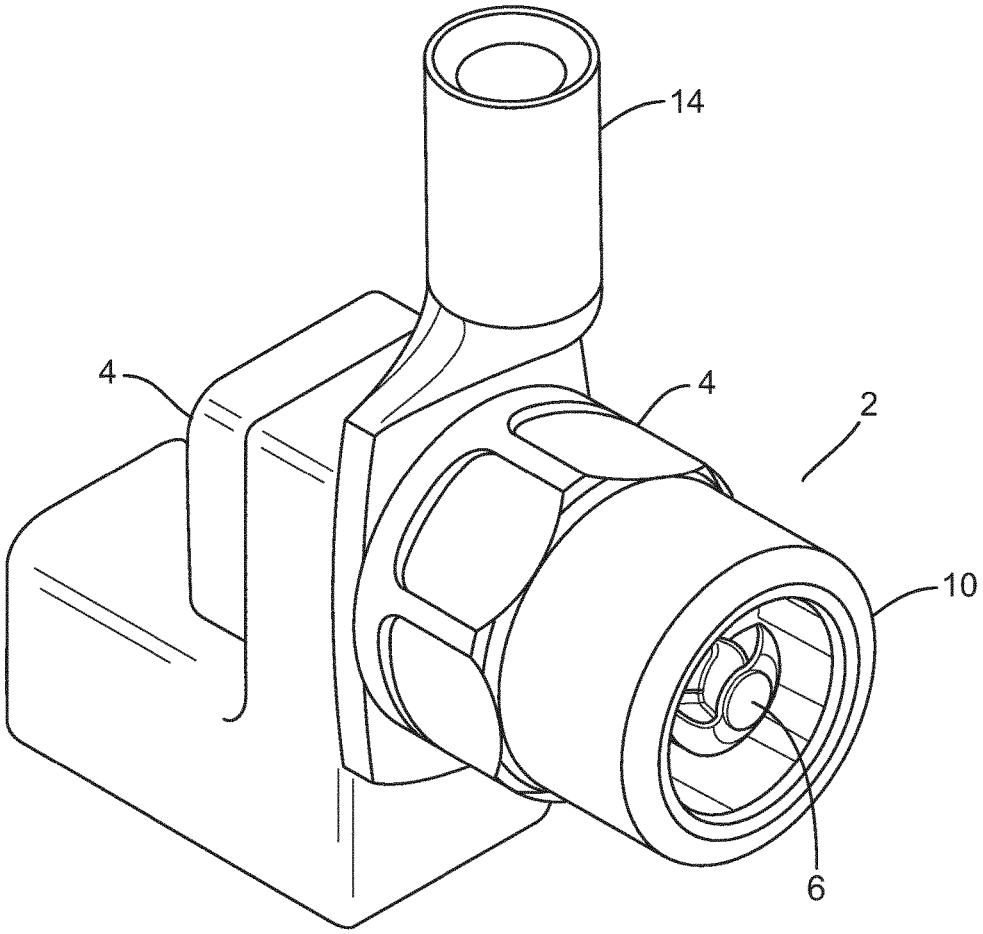
FIG. 1B is a schematic perspective view of the electrical connector according to one embodiment of the invention, wherein the connector is an assembled configuration.

With reference to FIG. 1, there is provided an electrical connector (2) comprising a quarter turn fastener (4), the quarter turn fastener (4) comprising a stud (6) having at least one helical cam slot (8) and a receptacle (10) comprising at least one cam follower (24) and a biasing means (12), the connector further comprising means for connection (14) to an electrical assembly, wherein the electrical connector has a first electrical contact surface (16) and a second electrical contact surface (17) and releasably connects the first and second surfaces in operative engagement, and wherein the electrical connector maintains a constant clamp force across the surfaces.

The quarter turn fastener (4) comprises a body (18) having a head (20) at one end thereof. The body (18) is substantially cylindrical in shape and comprises a central longitudinal axis. The body (18) extends between a first end and a second end wherein the second end of the body is attached to the head (20). The longitudinal axis of the body (18) is substantially perpendicular to the longitudinal axis of the head (20). The body (18) extends from the underside of the head and is smaller in diameter than the diameter of the head (20). In the embodiment shown in the Figures, the head (20) has a substantially square shape and is larger in diameter than the body. The body (18) comprises a pair of diametrically opposed helical cam slots (8) provided at the end of the body distal to the end attached to the head. As shown in the Figures, each slot (8) is cut from the leading end of the body (18) and extends along the body towards the head (20). In one embodiment, the open end of the at least one cam slot (8) may be widened to facilitate coupling and/or uncoupling of the stud (6) with the at least one cam follower (24) of a complementary receptacle (10). Preferably, the at least one cam slot (8) has a bayonet configuration and extends from the leading end of the body towards the head, terminating at a locking detent (21) wherein the corresponding cam follower (24) preferably sits when the stud is connected to the receptacle.

Preferably, the diameter of the stud at the end comprising at least one cam slot is approximately 6 mm. Preferably, the outer diameter of the receptacle is 14 mm. Preferably, the length of the receptacle along the longitudinal axis is 16 mm.

Figure 2A:
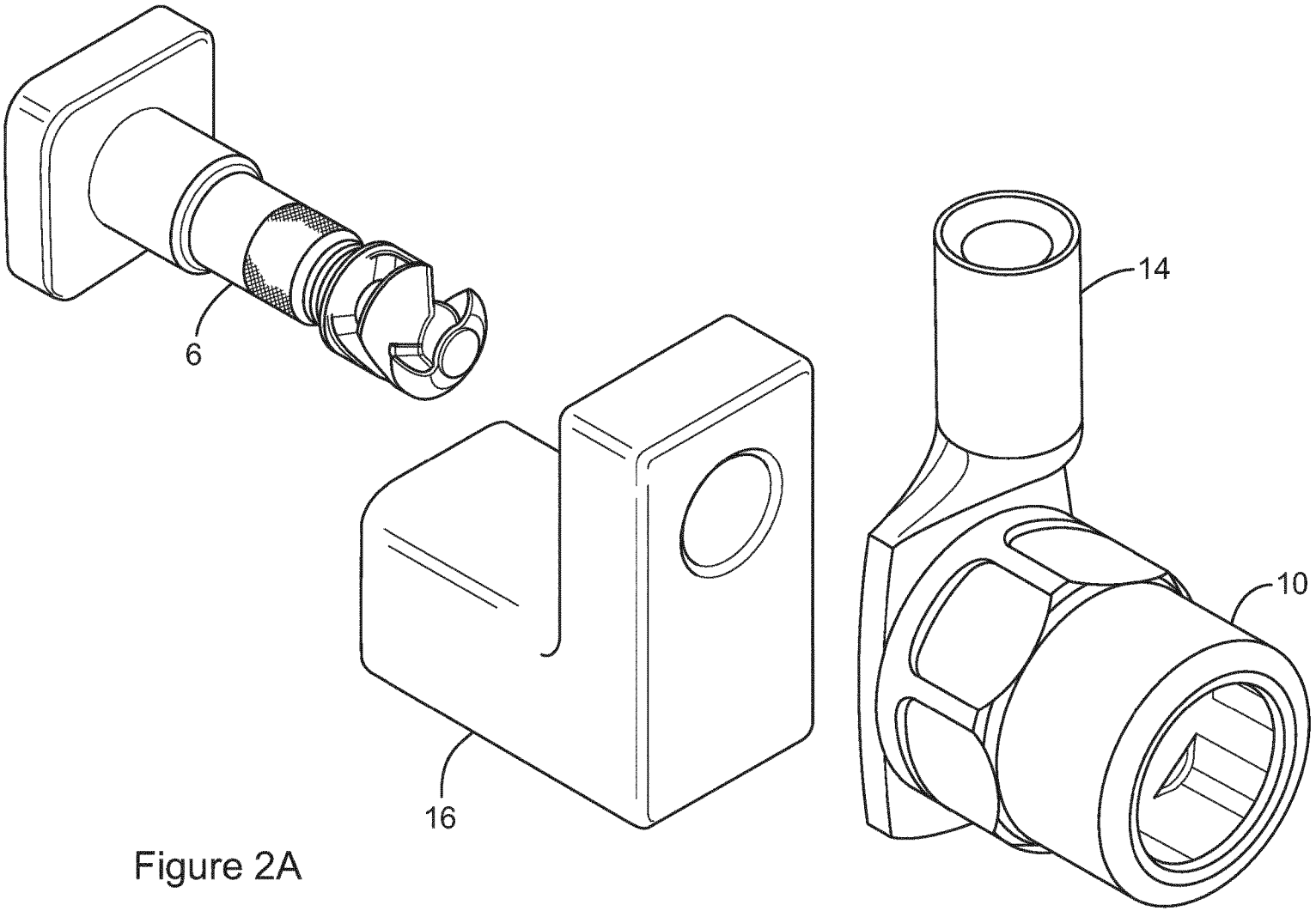
FIG. 2A is a schematic perspective view of the electrical connector shown in FIG. 1, showing the sub-assembled parts.
Figure 2B:
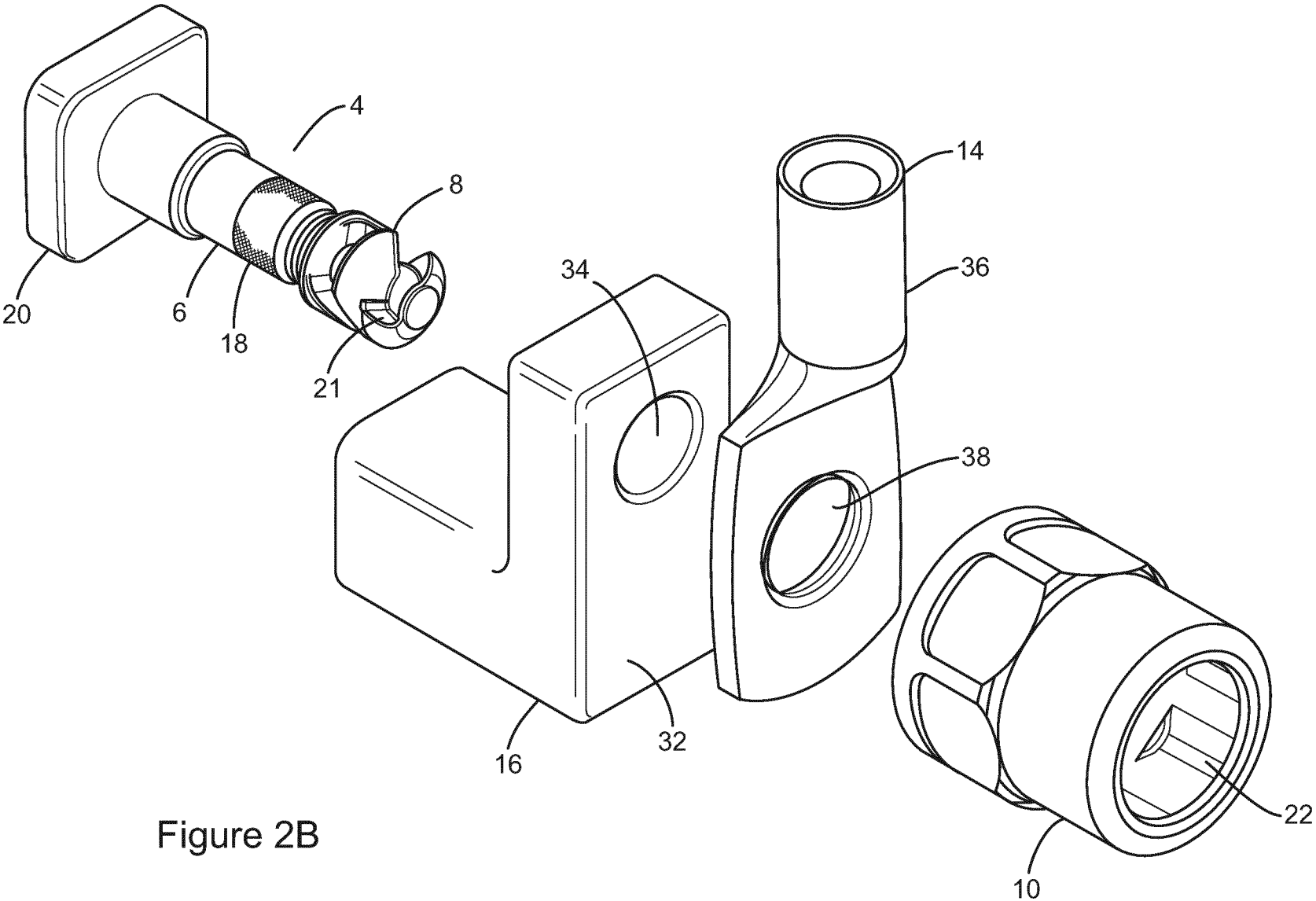
FIG. 2B is a schematic perspective view of the electrical connector shown in FIG. 1, wherein the connector is in a disassembled configuration.
Figure 3:
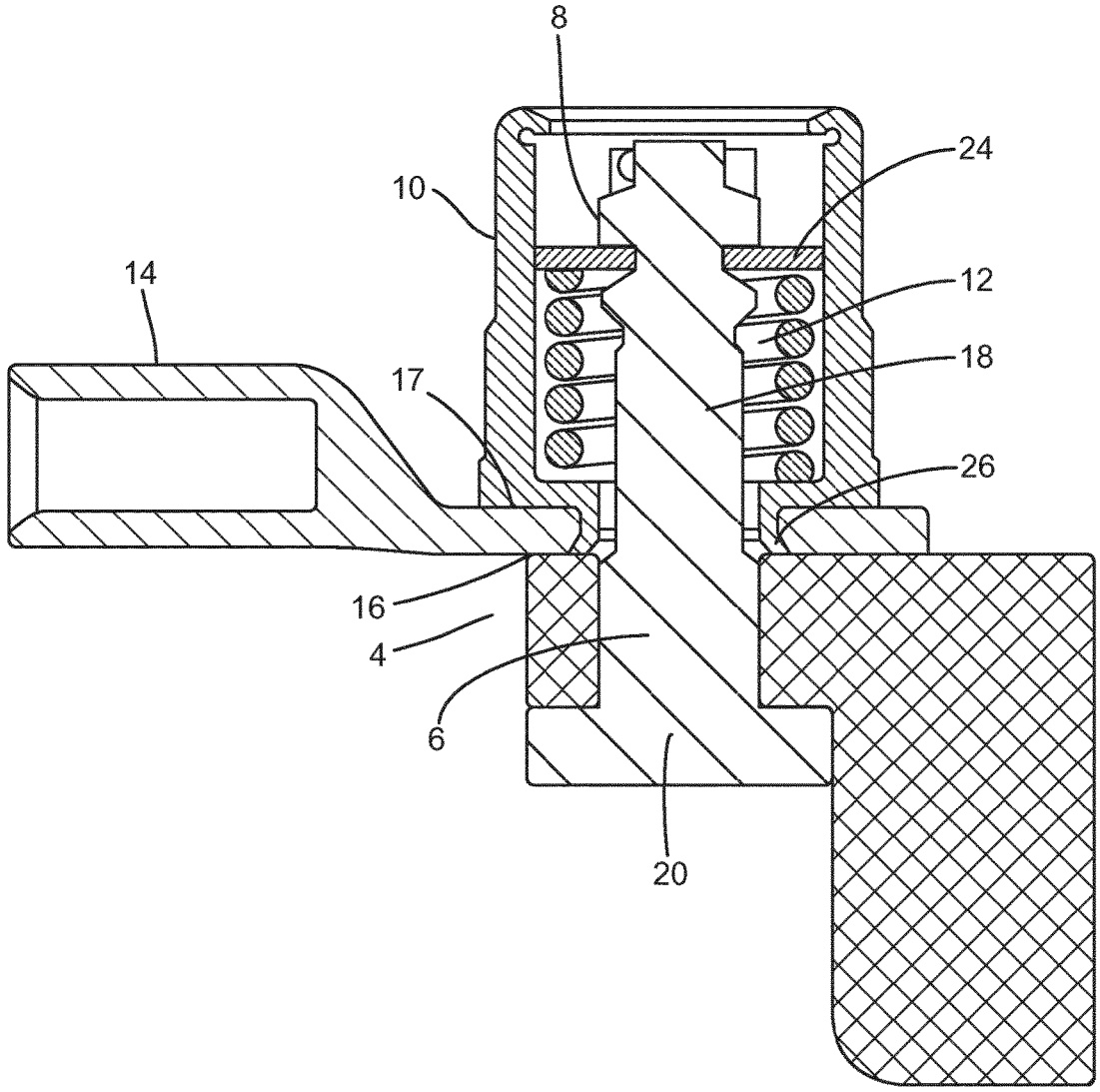
FIG. 3 is a side plan view of the electrical connector shown in FIG. 1.
Figure 4:
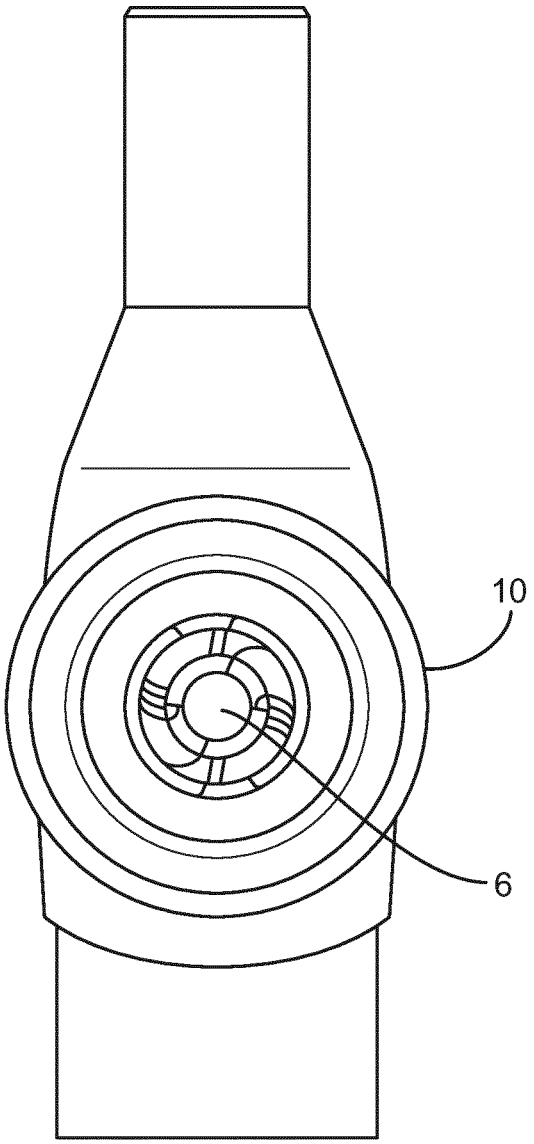
FIG. 4 is a schematic end view of the electrical connector shown in FIG. 1.
Figure 5:
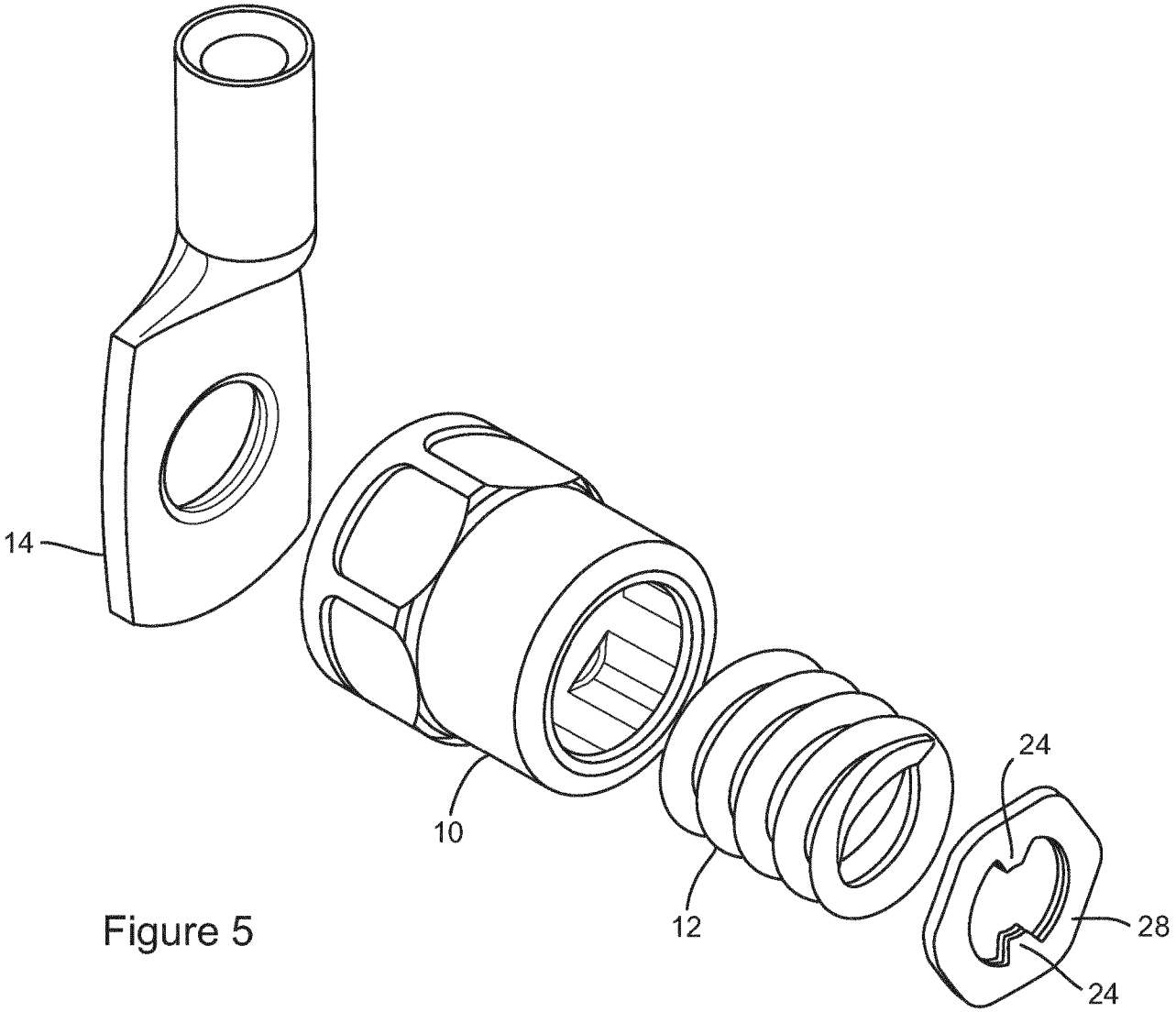
FIG. 5 is a schematic perspective view of a receptacle and a spade of an electrical connector in accordance with one embodiment of the invention, wherein the receptacle and spade and in the disassembled configuration.

With reference to FIGS. 1, 2 and 5, the receptacle (10) partially has the shape of a hexagonal prism and is also partially cylindrical in shape. The receptacle (10) comprises an inner recess (22) shaped to accommodate the body (18) of the stud. The inner recess (22) comprises two cam followers (24) to facilitate coupling of the stud (6) and the receptacle (10). The cam followers (24) are provided within an interface plate (28). The cam followers are provided in the form of a pair of tabs directed across the interface plate (28). As the body of the stud is introduced through the upper open end of the receptacle, it comes into contact with the cam followers provided on the interface plate, wherein the cam followers may be aligned with the entrance to the cam slots by a small initial rotation of the stud. The cam followers (24) may be held in place after connection with the stud via the locking detent (21) which terminates the corresponding cam slots. The inner recess (22) of the receptacle (10) further comprises the biasing means (12). In this embodiment, the biasing means (12) comprises a spring. Typically, the spring and the interface plate (28) are captivated within the receptacle (10). Advantageously, the biasing means allows for relative axial movement of the cam follower and stud within the receptacle, facilitating connection and disconnection of the fastener. Typically, the interface plate (28) is not rotatable within the receptacle (10) but is free to move axially against the spring pressure.

In the embodiment shown, for example, in FIG. 5, two cam followers (24) are provided on the interface plate (28). Typically, the at least one cam follower (24) may be held in place after connection with the stud via the locking detent (21) provided within the at least one cam slot. Preferably, the at least one helical cam slot (8) is provided on the stud (6) to allow for quarter turn rotation of the body (18) with respect to the receptacle (10) to open or close the fastener, respectively. Preferably, the body of the stud (6) rotates through between 90 and 180 degrees, preferably through 140 degrees, with respect to the receptacle (10) to open or close the fastener.

With reference to the figures, the electrical connector further comprises a battery post (32) comprising an aperture (34). In this embodiment, the aperture (34) is substantially circular in shape and is dimensioned to accommodate the body (18) of the stud (6), such that the body of the stud may pass through the aperture (34). Typically, the receptacle (10) is mounted on the battery post (32) through use of an undercut or deformable flange (26) to encompass all or part of the post thickness. Preferably, the stud (10) is captivated to the post (32) when in the assembled configuration. In one embodiment, the head (20) of the stud is square in shape and is fixed to the post (32) and doesn't rotate with the post (32).

With reference to the figures, the means for connection (14) to an electrical assembly comprises a spade (36) comprising an aperture (38). In this embodiment, the aperture (38) is substantially cylindrical and has substantially the same diameter as the aperture (34) provided within the post (32). Typically, the means for connection (14) to an electrical assembly may further comprise cables which lead from the spade to a battery. Preferably, the receptacle is captivated to the spade but is able to rotate the entire assembly. Preferably, the flange face of the receptacle is formed such that it corresponds with the spade to which it is captivated.

Advantageously, the body of the stud typically passes through the aperture within the battery post and the aperture within the spade and is accommodated within the receptacle.

In a preferred embodiment, the electrical connector may be used for connection to a battery in a car or other vehicle. Advantageously, the electrical connector of the present invention allows for quick disconnection of the fastener which is of great benefit when vehicles are loaded onto a ship, train or other transport means, wherein the battery of the vehicle is required to be disconnected before transport begins.

Figure 6:
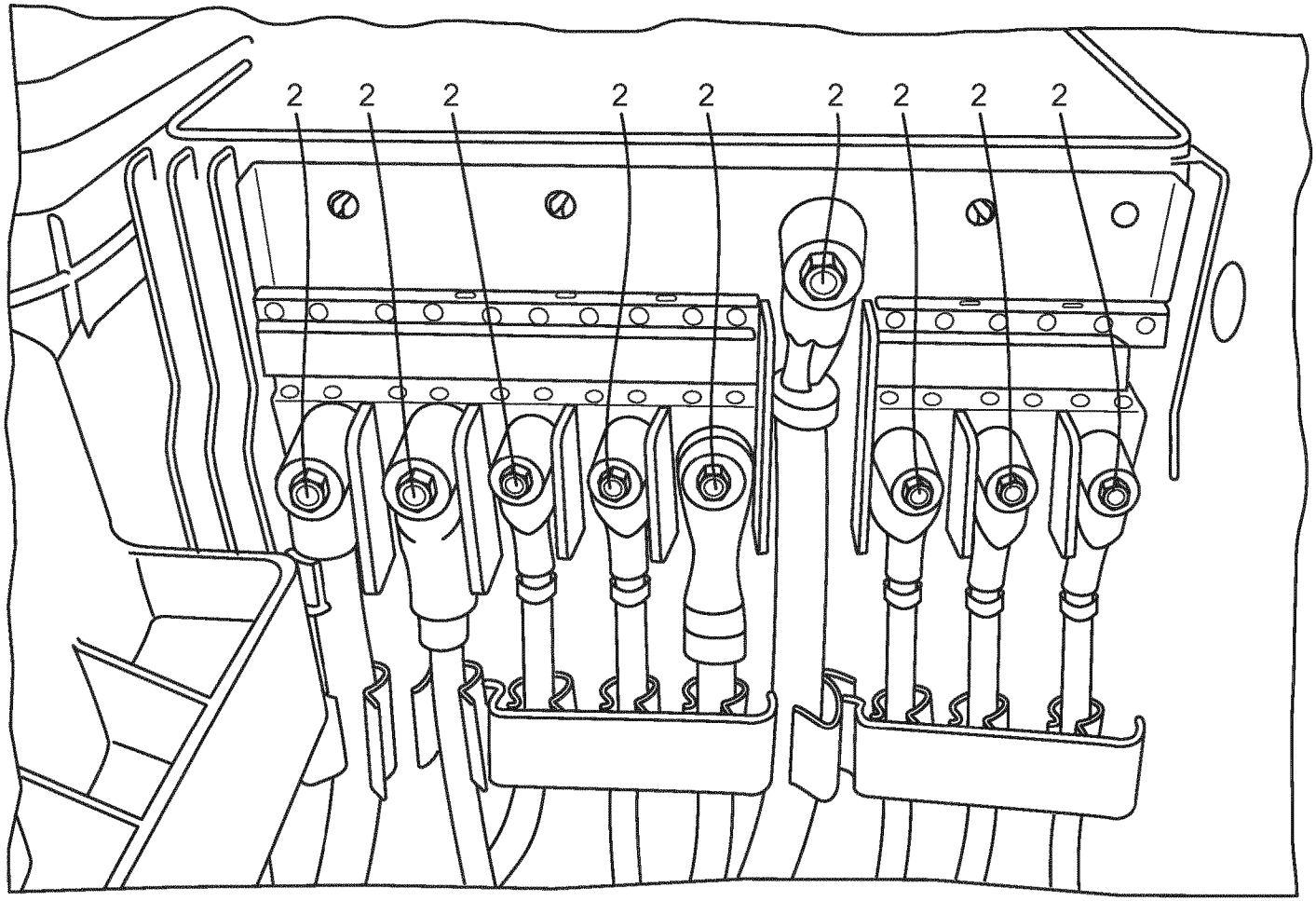
FIG. 6 shows a fuse box within a car comprising the electrical connector in accordance with an embodiment of the invention.

FIG. 6 shows a fuse box comprising one embodiment of the electrical connector of the invention. The fuse box comprises standard components and also comprises an electrical connector (2) as described above.

With reference to the figures, there is also provided a method for connecting an electrical connection comprising an electrical connector in accordance with the first aspect.

Preferably, the method comprises connecting a stud (6) having at least one helical cam slot (8) and a receptacle (10) comprising at least one cam follower (24) and a biasing means (12), the method further comprises providing a first electrical contact surface (16) and a second electrical contact surface (17) and releasably connecting the first and second surfaces in operative engagement, and wherein the electrical connector maintains a constant clamp force across the surfaces.

Typically, the method comprises the step of passing the body of the stud (6) through an aperture provided within a spade before connection of the stud and receptacle. Preferably, the method comprises the step of passing the body of the stud through an aperture provided within a post, such as a battery post.

With reference to the figures, there is provided a method of making an electrical connector in accordance with the first aspect.

With reference to the figures, there is also provided a kit comprising an electrical connector in accordance with the first aspect.

The invention claimed is:

1. An electrical connector comprising a quick release fastener and a connector for connection to an electrical assembly, the quick release fastener comprising a stud having at least one helical cam slot and a receptacle comprising at least one cam follower and a biasing means, the connector for connection to an electrical assembly comprising a first electrical contact surface and a second electrical contact surface, the connector having an arrangement such that the stud is oriented in a fixed relation to the first electrical contact surface, the receptacle is rotatable relative to the stud, and the receptacle is captivated whilst rotatable up to and against the second electrical contact surface such that the fixed electrical contact surface and the moveable electrical contact surface are in operative engagement, and wherein the electrical connector maintains a constant clamp force across the surfaces.

2. The electrical connector according to claim 1, wherein the biasing means comprises a spring.

3. The electrical connector according to claim 1, wherein the stud comprises a body having a head at one end thereof.

4. The electrical connector according to claim 3, wherein the body is substantially cylindrical in shape and comprises a central longitudinal axis.

5. The electrical connector according to claim 3, wherein the body extends between a first end and a second end wherein the second end of the body is attached to the head.

6. The electrical connector according to claim 3, wherein the body comprises at least one helical cam slot at one end thereof.

7. The electrical connector according to claim 3, wherein the body comprises a pair of diametrically opposed helical cam slots.

8. The electrical connector according to claim 3, wherein the at least one cam slot has a bayonet configuration and extends from a leading end of the body towards the head, terminating at a locking detent.

9. The electrical connector according to claim 1, wherein the receptacle comprises an inner recess shaped to accommodate the body of the stud.

10. The electrical connector according to claim 9, wherein the inner recess comprises at least one cam follower to facilitate coupling of the stud and the receptacle.

11. The electrical connector according to claim 9, wherein the inner recess of the receptacle further comprises the biasing means.

12. The electrical connector according to claim 1, wherein the receptacle comprises an interface plate comprising the at least one cam follower.

13. The electrical connector according to claim 12, wherein the interface plate comprises a pair of diametrically opposed inwardly extending cam followers.

14. The electrical connector according to claim 12, wherein the spring and the interface plate are captivated within the receptacle.

15. The electrical connector according to claim 12, wherein the interface plate is free to move axially within the receptacle against the spring pressure.

16. The electrical connector according to claim 1, wherein the means for connection to an electrical assembly comprises a spade.

17. The electrical connector according to claim 16, wherein the spade comprises an aperture.

18. The electrical connector according to claim 17, wherein the aperture is substantially cylindrical and has substantially the same diameter as the aperture provided within the post.

19. The electrical connector according to claim 1 for connection to a battery in a car or other vehicle.

20. The electrical connector according to claim 1, wherein the connector further comprises a post such as a battery post comprising an aperture.

21. The electrical connector according to claim 20, wherein the aperture is dimensioned to accommodate the body of the stud.

22. The electrical connector according to claim 20, wherein the aperture is substantially circular in shape.

23. The electrical connector according to claim 20, wherein the receptacle is mounted on the post using an undercut or deformable flange to encompass all or part of the post thickness.

24. A kit for making an electrical connection comprising an electrical connector according to claim 1.

25. A method for connecting an electrical connection comprising an electrical connector according to claim 1, comprising a step of connecting a stud having at least one helical cam slot and a receptacle comprising at least one cam follower and a biasing means.

26. The method of claim 25, the method further comprises providing a fixed electrical contact surface and a moveable electrical contact surface and releasably connecting the fixed electrical contact surface and the moveable electrical contact surface in operative engagement, and wherein the electrical connector maintains a constant clamp force across the surfaces.

27. The method of claim 25, comprising a step of passing the body of the stud through an aperture provided within a spade before connection of the stud and the receptacle.

28. The method of claim 25, further comprising a step of passing the body of the stud through an aperture provided within a post or a battery post.

* * * * *